United States Patent [19]

Zepkin

[11] 4,335,834

[45] Jun. 22, 1982

[54] HAND HELD ELECTRIC EJECTING DEVICE

[76] Inventor: Marvin Zepkin, 366 Bobwhite Dr., Bird Key, Sarasota, Fla. 33577

[21] Appl. No.: 164,816

[22] Filed: Jun. 30, 1980

[51] Int. Cl.[3] ..... B67D 5/46

[52] U.S. Cl. ..... 222/63; 222/327; 222/333; 222/390

[58] Field of Search ..... 222/325–327, 222/390, 333, 63; 318/468

[56] References Cited

U.S. PATENT DOCUMENTS

| | | | |
|---|---|---|---|
| Re. 26,180 | 4/1967 | Frenzel et al. | 222/333 X |
| 2,978,621 | 4/1961 | Martinek | 318/674 |
| 3,702,430 | 11/1972 | Knetsch | 318/468 |
| 3,854,629 | 12/1974 | Blieberger | 222/333 X |
| 4,114,781 | 9/1978 | Doyel | 222/326 |
| 4,180,187 | 12/1979 | Ben-Haim | 222/326 |

*Primary Examiner*—Charles A. Marmor

*Attorney, Agent, or Firm*—Craig and Antonelli

[57] ABSTRACT

A hand held electric ejecting device is disclosed for ejecting material such as caulking from a cartridge. The ejecting device comprises in combination, a receptacle for receiving therein a cartridge containing a material to be ejected, the cartridge having a dispensing opening at one end and being adapted to receive a pusher at the other end for forcing the material in the cartridge through the dispensing opening; a pusher movable when driven through the cartridge from the other end to force the material in the cartridge through the dispensing opening, the pusher including a push rod; and an electric motor positioned adjacent one end of the receptacle and connected to the device, the push rod passing through the electric motor and being axially driven thereby for effecting movement of the pusher to force material through the dispensing opening of the cartridge.

16 Claims, 5 Drawing Figures

HAND HELD ELECTRIC EJECTING DEVICE

BACKGROUND AND SUMMARY OF THE INVENTION

The present invention relates to a hand held electric ejecting device for ejecting material such as caulking from a cartridge.

Various hand held electric ejecting devices for ejecting materials from a cartridge are known. In such devices the electric motors are positioned to one side or beneath the cartridge and its support. One such prior art device is shown in U.S. Pat. No. 4,180,187. In this prior art device the motor is positioned beneath the cartridge and its support. As a result of this arrangement a relatively complex driving mechanism, one employing gearing or sprockets, a chain drive and a clutch member, is necessary to advance the pusher. The necessity for such a driving mechanism not only renders the device relatively expensive but also increases the weight thereof which adversely affects the ease with which such a device may be used.

An object of the present invention is to provide a hand held electric ejecting device for ejecting material such as caulking from a cartridge which overcomes the aforementioned disadvantages of the prior art devices.

More particularly, an object of the present invention is to provide a hand held electric ejecting device for ejecting material from a cartridge, which is relatively simple in design using a minimum number of parts whereby there results an ejecting device of relatively low cost and weight.

A further object of the present invention is to provide a device of the aforementioned type which is more compact, slimmer, better balanced with respect to the longitudinal axis of the device and hence easier to use than known devices.

This and other objects of the present invention are attained by providing a hand held electric ejecting device for ejecting material from a cartridge comprising in combination, receptacle means for receiving therein a cartridge containing a material to be ejected, said cartridge having a dispensing opening at one end and being adapted to receive a pusher means at the other end for forcing the material in the cartridge through the dispensing opening; pusher means movable when driven through said cartridge from said other end to force the material in the cartridge through said dispensing opening, said pusher means including a push rod; and an electric motor positioned adjacent one end of said receptacle means and connected to said device, said push rod passing through the electric motor and being axially driven thereby for effecting movement of the pusher means to force material through the dispensing opening of the cartridge.

In a disclosed embodiment of the present invention the push rod is a screw shaft which is in longitudinal alignment with the cartridge and extends through the center of the motor. More specifically, the screw shaft passes through an armature shaft of the motor, threads on the armature shaft drivingly engaging the screw shaft thereby translating rotary motion of the armature shaft to axially drive the screw shaft.

A further feature of the present invention involves the provision of means for automatically shutting off the electric motor after the pusher means has been driven a predetermined, adjustable distance. According to the disclosed embodiment of the present invention this automatic shutoff means includes an adjustable stop provided on the push rod and a switch in the form of a plunger pin mounted on the electric motor adjacent to the push rod passing through the motor, the switch being actuated by the stop to shut off the motor after the pusher means has been driven the predetermined, adjustable distance.

A pistol grip is provided on the disclosed device. This grip is connected to the electric motor and has a trigger switch for actuation of the electric motor.

According to the disclosed form of the present invention the receptacle means is in the form of a cylinder for receiving the cartridge. The cylinder is provided with removable end caps. One of these end caps is connected to the motor whereby the motor can be removed for replacement or repair.

BRIEF DESCRIPTION OF THE DRAWINGS

These and other objects, features and advantages of the present invention will become more apparent from the following description when taken in connection with the accompanying drawings which show, for purposes of illustration only, one embodiment in accordance with the present invention and wherein.

DETAILED DESCRIPTION OF THE DRAWINGS

Figure 1:
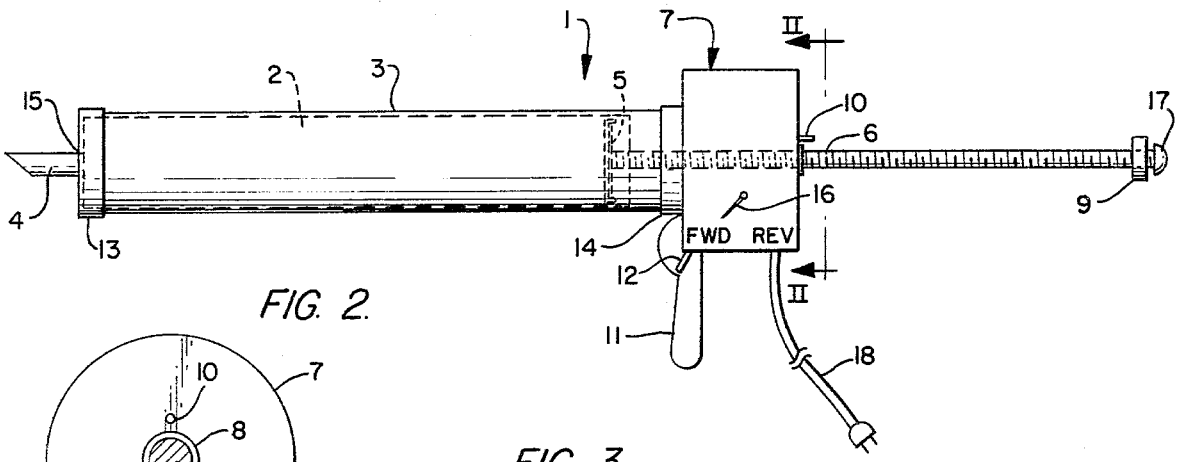
FIG. 1 is a side view of a hand held electric ejecting device in accordance with the present invention.
Figure 2:
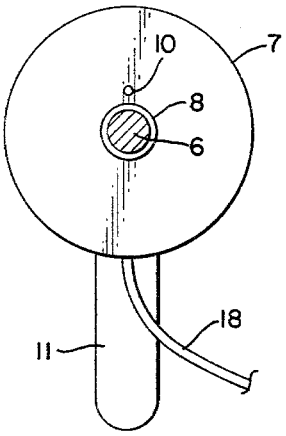
FIG. 2 is a cross-sectional view of the device of FIG. 1 taken along line II—II of FIG. 1.
Figure 3:
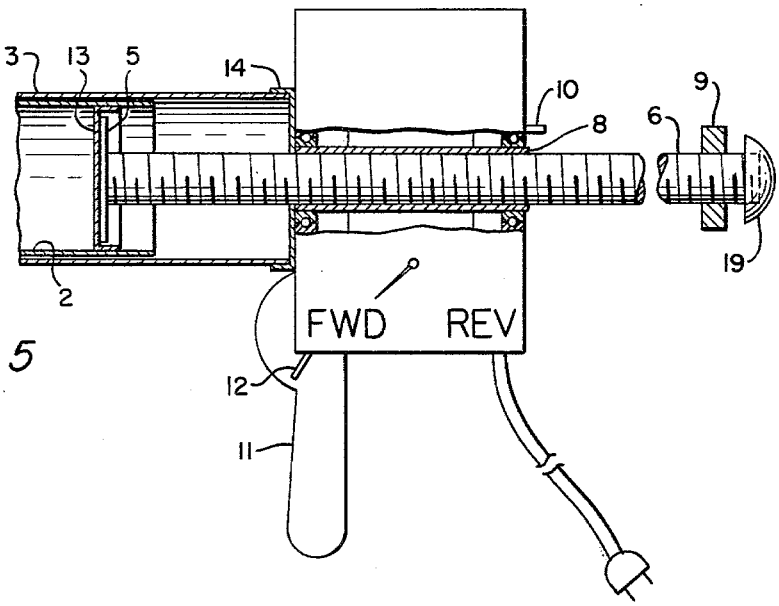
FIG. 3 is a partial cross-sectional view taken from the side of the device of FIG. 1 and illustrating the driving relationship between the piston rod and the electric motor.

Referring now to the drawings wherein like reference numerals are used throughout the four views to designate like parts a hand held electric ejecting device for ejecting material from a cartridge 2 comprises a receptacle in the form of a cylinder 3 for receiving therein the cartridge 2 containing the material to be ejected. The cartridge has a dispensing opening in the form of a nozzle 4 at one end and is adapted to receive a pusher at the other end for forcing the material in the cartridge through the dispensing opening.

The pusher includes a pusher member 5 and a push rod 6 in the form of a screw shaft connected to the pusher member. Movement of the pusher through the cartridge forces the material in the cartridge through the dispensing opening or nozzle.

Figure 5:
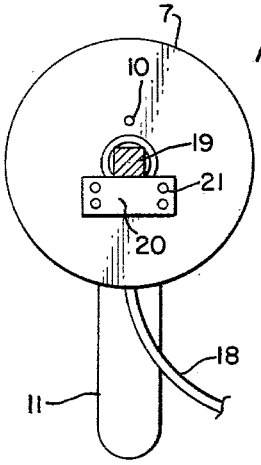
FIG. 5 is a view similar to FIG. 2 but showing the use of a square screw shaft and a plate mounted on the motor and cooperating with a flat side of the shaft to prohibit rotation thereof while permitting axial movement of the shaft.
Figure 4:
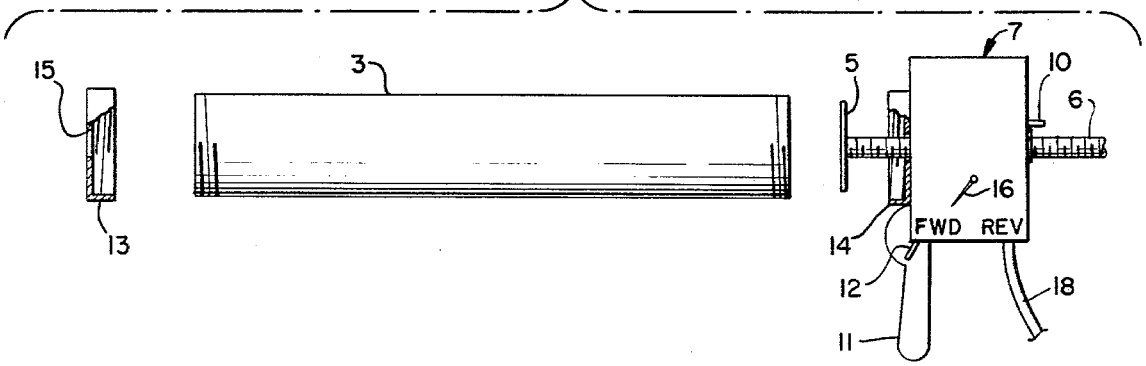
FIG. 4 is a side view of the device of FIG. 1 in a disassembled condition for replacement or repair of component parts.

An electric motor 7 is positioned adjacent one end of the cylinder 3 and is connected to the device. The electric motor is of the type having a central armature shaft 8 through its center. The armature shaft has a central passage therethrough which is threaded to receive the screw shaft 6. Rotational movement of the armature shaft 8 during operation of the motor effects axial or linear movement of the screw shaft 6 and the associated pusher member 5 for forcing material through the dispensing opening of the cartridge. The screw shaft 6 is prevented from rotation by the load placed upon it by the cartridge. Also, provision can be made for preventing rotation of the screw shaft 6 by, for example, providing the screw shaft in the form of a square shaft 19 as shown in FIG. 5. In this case a plate 20 is removably attached to the motor 7 by means of fasteners such as screws 21. The plate 20 engages a flat side of the screw shaft 19 and prevents rotation thereof while permitting axial movement of said shaft. The plate can be removed for unscrewing the shaft from the motor in the event of motor failure.

End caps 13 and 14 are screwed onto the respective ends of the cylinder 3 containing the cartridge. The end cap 13 is provided with an opening 15 through which the nozzle 4 of the cartridge 2 projects. Because the cylinder 3 is readily removed from the end cap 13 and also the end cap 14 and associated motor 7, in the case of motor failure, a new motor can be readily installed on the device or at least the inoperative motor can be readily repaired. Also, such an arrangement permits removal of one cylinder 3 and installation of a longer cylinder, for example, for use with larger cartridges.

A pistol grip 11 is connected to the electric motor 7 to permit the operator to readily manipulate and use the device. A trigger switch 12 is provided on the pistol grip for actuation of the electric motor. The motor is connected to a suitable electrical source by means of the electrical cord 18. Alternatively, a battery pack could be attached to the device and employed as the power source for operation of the motor.

As shown in the application drawings, the screw shaft 6 is in longitudinal alignment with the cartridge and extends through the center of the motor 7. The axial or linear displacement of the screw shaft 6 can be set to a predetermined distance by means of an adjustable stop nut 9 which is provided on screw shaft 6. A switch 10 in the form of a plunger pin extends outwardly from the electric motor adjacent to the push rod passing through the motor. As the screw shaft 6 is driven forwardly, the adjustable stop nut 9 approaches and then actuates the plunger pin to interrupt the electrical power and thereby shut off the electric motor 7. Since the position of the stop 9 along the shaft 6 can be varied, a predetermined, adjustable stroke length or distance may be set. A switch 16 is also provided on the motor 7 for selectively operating the motor in forward or reverse directions for advancing or withdrawing the pusher with respect to the cartridge.

As evident from the above detailed description, the ejecting device of the present invention employs a minimum number of parts in a manner which results in a compact, slim and lightweight device which is relatively low in cost as compared with prior art devices. The device of the present invention is also better balanced with respect to the longitudinal axis of the device and is easier to use.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A hand held electric ejecting device for ejecting material from a cartridge comprising in combination, receptacle means for receiving therein a cartridge containing a material to be ejected, said cartridge having a dispensing opening at one end and being adapted to receive a pusher means at the other end for forcing the material in the cartridge through the dispensing opening; pusher means movable when driven through said cartridge from said other end to force the material in the cartridge through said dispensing opening, said pusher means including a push rod formed as a screw shaft; and an electric motor positioned adjacent one end of said receptacle means and directly connected to said receptacle means, said screw shaft passing through an armature shaft of the electric motor, threads being provided on said armature shaft in driving engagement with said screw shaft for axially driving said screw shaft for effecting movement of the pusher means to force material through the dispensing opening of the cartridge, whereby said device is relatively lightweight, slim, compact and easy to use.

2. The ejecting device according to claim 1, wherein said push rod is in longitudinal alignment with the cartridge and extends through the center of the motor.

3. The ejecting device according to claim 1, wherein means are provided for automatically shutting off said electric motor after said pusher means has been driven a predetermined, adjustable distance.

4. The ejector device according to claim 3, wherein said automatic shutoff means includes an adjustable stop provided on said push rod and an electrical switch mounted on said electric motor adjacent to the push rod passing through said motor, said electrical switch being actuated by said stop to shut off the motor after said pusher means has been driven said predetermined, adjustable distance.

5. The ejector device according to claim 4, wherein said electrical switch mounted on said motor is in the form of a plunger pin.

6. The ejector device according to claim 1, wherein a pistol grip is connected to the device, a trigger switch being provided on the pistol grip for actuation of said electric motor.

7. The ejector device according to claim 6, wherein the pistol grip is connected to the electric motor.

8. The ejector device according to claim 1, wherein said motor is removably attached to said receptacle means to permit replacement or repair of said motor.

9. The ejector device according to claim 1, wherein said receptacle means includes a cylinder for receiving the cartridge.

10. The ejector device according to claim 9, wherein said cylinder is provided with removable end caps.

11. The ejector device according to claim 10, wherein said cartridge includes a nozzle at said one end about said dispensing opening, one of said end caps of the receptacle means having an opening for receiving said nozzle.

12. The ejector device according to claim 11, wherein the other of said end caps of the receptacle means is connected to said motor whereby the motor can be removed from the cylinder of said receptacle means for replacement or repair.

13. The ejector device according to claim 1 or 4, wherein said pusher means further includes a pusher member connected to the end of the pusher rod adjacent the cartridge.

14. The ejector device according to claim 1, wherein switch means is provided for selectively operating said motor in forward or reverse directions for advancing or withdrawing the pusher means with respect to the cartridge.

15. The ejector device according to claim 13, wherein said push rod is a screw shaft having at least one relatively flat side, and wherein means are provided on an outer surface of said motor for engaging said at least one flat side of said shaft to prevent rotation of the shaft while permitting axial movement thereof.

16. The ejector device according to claim 15, wherein said means preventing rotation of said shaft is a plate which is removably attached to an outer surface of said motor.

* * * * *